US005155415A

United States Patent [19]

Schmidt et al.

[11] Patent Number: 5,155,415

[45] Date of Patent: Oct. 13, 1992

[54] HIGH VOLTAGE DRIVER FOR GAS DISCHARGE LAMPS

[75] Inventors: Ronald M. Schmidt, Burbank; Alfred T. Schmidt, North Hollywood; Madan M. Sharma, Palos Verdes, all of Calif.

[73] Assignee: Litebeams, Inc., Burbank, Calif.

[21] Appl. No.: 589,176

[22] Filed: Sep. 26, 1990

[51] Int. Cl.[5] ..... H05B 37/02

[52] U.S. Cl. ..... 315/224; 315/307; 315/159; 315/219

[58] Field of Search ..... 315/224, 307, 159, 219, 315/D4, D7, 208, 277

[56] References Cited

U.S. PATENT DOCUMENTS

| | | | |
|---|---|---|---|
| 4,682,084 | 7/1987 | Kuhnel et al. | 315/307 |
| 4,933,612 | 6/1990 | Bonin | 315/219 |
| 4,999,547 | 3/1991 | Ottenstein | 315/224 |

*Primary Examiner*—Eugene R. LaRoche
*Assistant Examiner*—R. Ratliff
*Attorney, Agent, or Firm*—Blakely, Sokoloff, Taylor & Zafman

[57] ABSTRACT

A pulse driver circuit for providing very high frequency pulses with fast rise time to neon or gas discharge lamps to thereby produce higher optical output than is possible using conventional drivers. Gas discharge lamps have at least two states of operation. One is the application of breakover voltage to initiate gas ionization which may be called the preionization state. The second state is known as the breakdown condition which is when the gas in the lamp has ionized and is producing the optical output. The pulse driver, starts the ionization at a relatively low breakover voltage because of its fast rise time. The pulse driver comprises an astable oscillator, the output of which passes through a pulse width capacitor. The generated pulse train drives a power driver transistor which causes current to flow through a transformer causing a voltage to be applied to a lamp. The power applied to the transformer is used in a feedback loop which provides pulse width control to keep the current applied to the transformer constant so that the output of the lamp is relatively constant over a given voltage range.

21 Claims, 3 Drawing Sheets

HIGH VOLTAGE DRIVER FOR GAS DISCHARGE LAMPS

BACKGROUND OF THE INVENTION

This invention is directed to a high efficiency driver for neon or gas discharge lamps. Present state of the art offers two types of drivers for neon or gas discharge lamps. One utilizes a line frequency step-up transformer which is typically used to drive neon signs. However, such transformers are large and expensive. The other type of driver commonly used comprises inverters that are based upon resonant circuit technology to step-up the voltage. However, due to their slow rise time and sinusoidal wave form output, resonant drivers do no drive the lamps to their full output capability. Therefore, in view of the lack of appropriate drivers, gas discharge lamps are generally limited to uses such as neon signs and the like.

SUMMARY OF THE INVENTION

The invented driver provides very high frequency pulses with fast rise time to neon or gas discharge lamps to thereby produce higher optical output than is possible using conventional drivers. This higher efficiency of the invented driver and the higher light output of the lamp allows gas discharge lamps to be considered as illuminating devices, including uses for critical applications such as heliport markers, runway lights, warning lights, hazard, and obstruction lights. Commercial products for such applications have one or more of the following attributes:

1. Open and short protection.
2. A power regulating system.
3. A current regulation system.
4. Optical feedback.
5. An output wave form which achieves instantaneous ionization along the entire length of the lamp.
6. Battery protection system to prevent batteries from discharging completely.
7. Battery status monitors.
8. Modes of operation to be continuous, flashing, or Morse code.
9. A driver that can be adapted to various lamps.

DETAILED DESCRIPTION OF THE INVENTION Theory of Operation

Gas discharge lamps have at least two states of operation. One is the application of breakover voltage to initiate gas ionization. The voltage across the lamp must reach the breakover point before the gas can start to ionize. This may be called the preionization state. The second state is known as the breakdown condition. This is when the gas in the lamp has ionized and is producing the optical output. The voltage across the lamp during the second state is much lower than the breakover voltage and it is this lower voltage which affects the intensity of the emitted light. The energy in a preionization pulse is expended to ionize the gas and does not contribute to the light output. Therefore, this energy is wasted and, therefore, results in an overall inefficiency. In this connection, observing the behavior of drive systems and lamps under test revealed the cause of inefficiencies in conventional drivers. Specifically, both step-up transformers and resonant drivers have slow rise times requiring high breakover voltage. Therefore, conventional drivers must be designed to provide the high voltage needed to reach the breakover voltage or preionization state. The energy required by a preionization pulse can be calculated by:

$$Ei=\tfrac{1}{2}CV^2$$

where Ei is energy in Joules/pulse, C is the capacitance of the output circuit plus the capacitance of the lamp, and v is the breakover voltage. This energy does not contribute to the light output since it is dissipated and is used only to start up the ionization of the gas.

The present invention, in contrast, starts the ionization at a much lower breakover voltage because of its fast rise time. This is in concurrence with the known fact that switching devices such as gas filled thyratrons breakdown at lower voltages with fast change in voltage dv/dt. This is why switching devices are specified for a maximum dv/dt to hold off inadvertent turn-on. Thus, the present invention uses fast rise time pulses to reduce the breakover voltage during the preionization state. Since the wasted energy is proportional to the square of the voltage, a decrease in the value of breakover voltage by one half reduces the lost energy by one quarter.

Another disadvantage of prior art drivers which the present invention avoids is that since prior art drivers require a high breakover voltage, a relatively large space is required between the lamp electrodes to avoid arcing due to the high breakover voltage. Since the invented pulse driver requires a much smaller (typically 3 times smaller) breakover voltage, the space between the electrodes can be reduced thereby simplifying mechanical constraints.

DESCRIPTION OF PREFERRED EMBODIMENT

Figure 1:
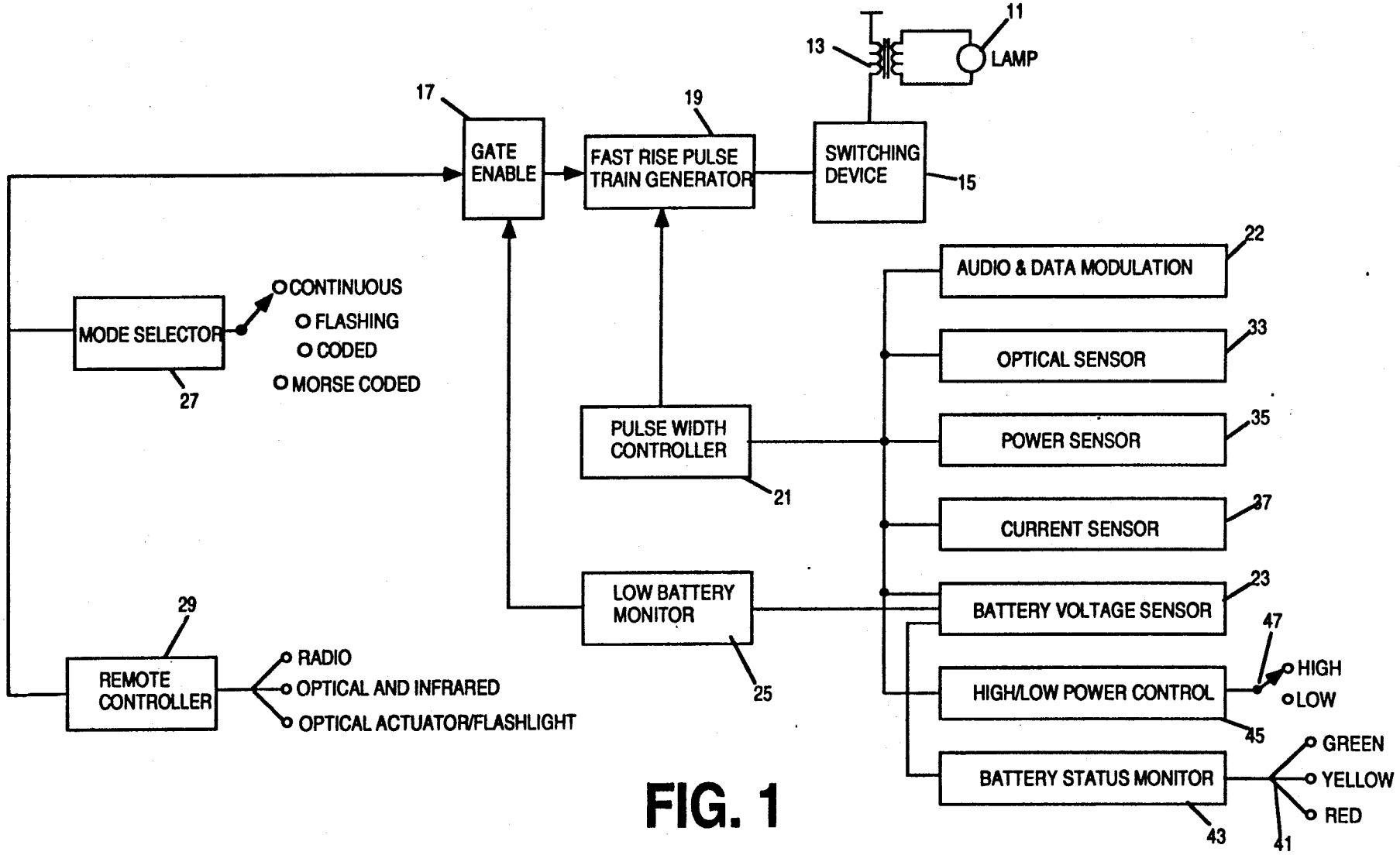
FIG. 1 is a block diagram of the invention.

FIG. 1 is a block diagram that describes a preferred embodiment of the invention. The combination of the functional elements shown as blocks in FIG. 1 are unique although detailed circuit implementations of each functional block may be varied without departing from the invention as defined in the claims. Therefore, the design and description of circuits at a component level is not pertinent to the invention. However, what is germane is the functional description and the specific requirements of the elements of this invention. Following is a brief description of operation of the circuit to demonstrate the reduction-to-practice of the invention as outlined in the previous section—Theory of Operation.

A gas discharge lamp 11 is driven by a step-up transformer 13. Step-up transformer 13 is a specially designed very low capacity and low inductance transformer capable of handling high frequency pulses of varying widths while maintaining high breakdown voltage characteristics.

A switching device 15 drives the transformer 13 with current pulses in a buck-boost mode. The switching device is a fast switching component such as an FET, a bipolar transistor, a combination of a bipolar transistor and FET (BIFET), a vacuum tube thyratron, a triggered spark gap, a crytron, or any switching device capable of carrying high peak currents. In the preferred embodiment, a high current FET (IRFZ40) is used. Also required is a pulse train generator 19 and an enable gate 17 which shuts off the pulse train generator 19 when the output of the enable gate is low.

Pulse width controller 21 controls the pulse width of a generated pulse train with a 3% to 50% duty cycle. In the preferred embodiment, pulse width controller 21 is CMOS hexinverter (74C14) along with timing capacitor. The pulse width controller uses inverters to output a variable duty cycle pulse train. The pulse width controller controls the duty cycle of the pulses generated by pulse train generator 19 thus affecting the optical output of the gas discharge lamp.

Pulse train generator 19 drives switching device 15 with a pulse train of pulse width modulated pulses with sharp rise time with adequate power to drive the switching device in a voltage saturated mode. The pulse train generator outputs pulses of frequencies ranging from 10 KHz to 1 MHz. The higher the frequency, the smaller the size of the transformer 13. In the preferred embodiment, the frequency is 40 KHz with a duty cycle varying between 3% and 50%. 40 KHz is a value which has been determined to optimize transformer losses. At higher frequencies, the core loss, the switching loss, and power lost in circuit capacities increases. These practical considerations indicate the best frequency to be 40 KHz. however, use of other frequencies apply to this invention just as well.

Pulse train generator 19 is provided with two control inputs. One is the enabling input from enable gate 17 which enables the pulse train generator to provide pulses to the transformer through the switching device. The other input from pulse width controller 21 controls the pulse width and thereby the optical output to the gas discharge lamp 11. These inputs may be used to provide features that have become possible due to this invention. For example, the enabling input may be used as a Morse code pulser, and the control input may incorporate an audio modulation signal generated by audio and data modulator 22.

Pulse width controller 21 processes signals from various sensors described below, and audio and data modulator 22 to control the pulse width of the generated pulse train to adjust the lamp output for the desired results. For example, battery voltage sensor 23 senses the voltage of a battery (not shown) used to operate the circuitry as it decreases with time. Controller 21 varies the pulse width to keep the lamp output constant at all times by increasing the duty cycle as the battery voltage decreases. The controller processes the signals from several types of sensors such as an optical sensor 33, power sensor 35, current sensor 37, battery voltage sensor 23, high/low power control 45, as well as audio and data modulator 22.

Enable gate 17 responds to the ON/OFF status of control signals from low battery monitor 25, mode selector 27 and remote controller 29. For example, lamp 11 can be triggered remotely by a radio wave transmission or a handheld optical stimulus such as an LED or laser or even a match stick optical starter applied to an optical actuator input to remote controller 29.

The application of enabling and pulse width circuits as described above to gas discharge lamp drivers are unique to this invention. Prior art drivers such as resonant circuits or 60 Hz drivers cannot provide enable and continuously variable light control.

The above-mentioned sensors may optionally be included to improve the reliability and usefulness of the invention as follows.

Optical sensor 33 senses the light output and generates signals instructing controller 21 to control the pulse width of the generated pulse train to achieve desired results. There are several methods to achieve this. However, in the preferred embodiment, a cadmium sulfide photo detector measures the light output from gas discharge lamp 11 and feeds back a signal to control the light output.

Power sensor 35 measures the power through the circuit to control the pulse width to keep power into the circuit at a desired level. For example, in the preferred embodiment, power sensor 35 keeps the power input from the battery below a predetermined level, for example 15 watts. This ensures reliability and predicts heat sink requirements. This also limits the current during short circuited output.

Current sensor 37 affects pulse width to adjust the duty cycle of the pulse train to optimize the frequency of the pulse train for the most efficient discharge rate of the battery. For example, current sensor 37 may be used to adjust the frequency of the pulse generator to provide the best duty cycle for variations in lamp characteristics. In the preferred embodiment, the frequency is adjusted between the range of 25 KHz to 60 KHz to accommodate lamps requiring 12 to 60 watts of power. In this manner, a generic basic circuit may be used to handle a variety of lamps.

Battery voltage sensor 23 senses battery voltage both during ON and OFF conditions. The difference between loaded and open circuit voltage assesses the battery status to control the pulse width and battery status indicators 41 described below. The difference between open circuit battery voltage Voc and battery voltage under load VL assesses the battery charge status. This difference in voltage generates a battery status signal (voltage) and is applied to voltage comparators to control (a) the battery status indicators (Green, Yellow and Red LEDs) and (b) to control the pulse width of the driver to control the current in a fashion such that optical power output is maintained at a constant level throughout the discharge cycle of the battery where battery voltage is decreasing with time. For example, in the preferred embodiment, a sequence of two pulses are generated. The first pulse is initiated by the turn-on of the driver. This pulse inhibits the lamp to light-up, therefore there is no appreciable load on the battery. This pulse also samples the battery voltage Voc and stores it in a capacitor. The second pulse starts the gas discharge lamp. Now the battery is loaded. The second pulse samples the battery and registers the loaded voltage VL and stores it in another capacitor. Both of these voltages are applied to two comparators to light-up the appropriate indicating LED. The difference between the voltages is used to estimate the status of the battery by battery status monitor 43 which is then indicated by indicating LEDs 41.

High/low power control 45 is manually operated by a high/low switch 47 to select the light output. In cases where low light output is sufficient, the low setting increases the battery life. For example, a battery can operate the lamp for 6 hours at the high setting and for 10 hours at the low setting.

Battery status monitor 43 responds to battery voltage sensor 23. Three LEDs, green, yellow and red, indicate battery condition, for example as follows: the green light indicates the battery has more than 75% charge, the red light indicates less than 25%, and the yellow light indicates between 75% and 25%.

Low battery monitor 25 responds to the battery voltage sensor 23. When the battery voltage has reached a low point (e.g., 9.8 volts), the low battery monitor disables the pulse train generator and shuts off the gas discharge lamp. It also disconnects all the circuits from the battery such that there is no further drainage of the battery. Without this shut-off function, the battery would discharge completely making it difficult to recharge, requiring many more hours than normal, thus deteriorating the expected life of the battery.

Mode selector 27 selects the mode of operation. In continuous mode, the lamp is "ON" constantly. In flashing mode, the lamp can be pulsed at a desired rate. Other features such as coded pulses or Morse code pulses can also be provided.

Specific circuit implementation details for audio and data modulator 22, optical sensor 33, power sensor 35, current sensor 37, battery voltage sensor 23, high/low power control 45, battery status monitor 43, low battery monitor 25, mode selector 27 and remote controller 29 are not needed for a complete understanding of the invention and such implementation details would be readily apparent to a person skilled in the art.

Figure 2:
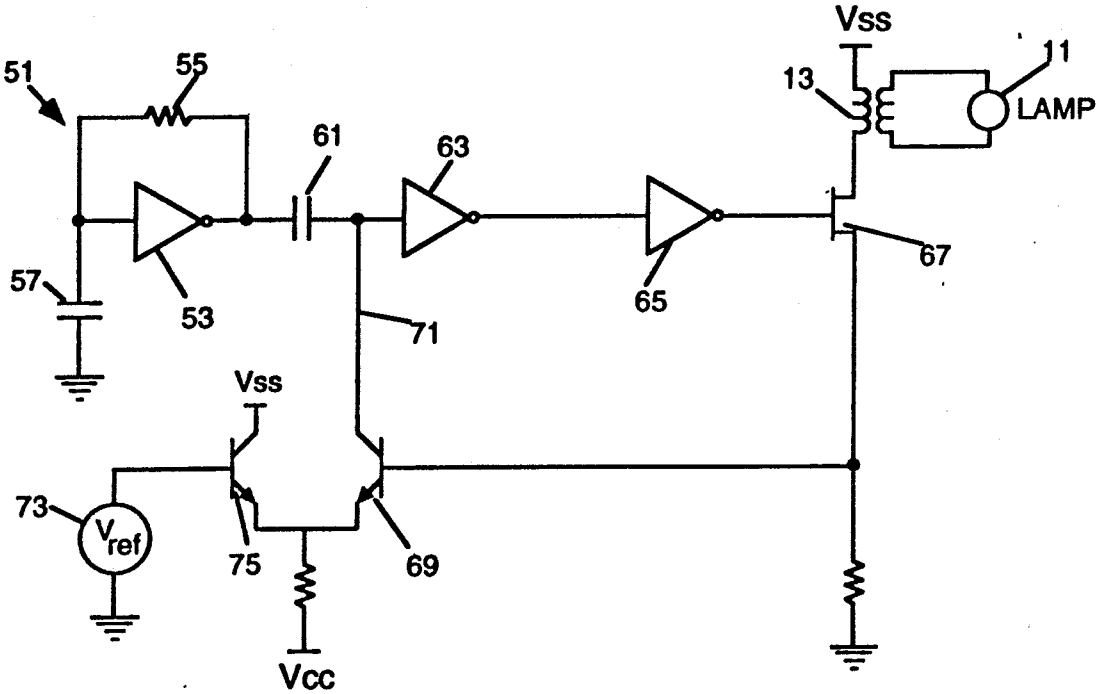
FIG. 2 is a schematic diagram showing a pulse driver circuit which forms part of the invention.

Referring now to FIG. 2, the pulse train generator 19 may be implemented using an astable oscillator 51 formed by inverter 53, resistor 55 and capacitor 57, the output of which passes through pulse width capacitor 61 then through inverters 63 and 65. The generated pulse train drives power driver transistor 67 which corresponds to switching device 15 of FIG. 1 causing current to flow through transformer 13 causing a voltage to be applied to lamp 11. The power applied to transformer 13 is used in a feedback loop to transistor 69 which provides pulse width control on line 71 by operation of voltage reference source 73 and transistors 75 and 69. The purpose of the feedback loop is to keep the current applied to transformer 13 constant so that the output of lamp 11 is relatively constant over a given voltage range. In this connection, in order to provide the advantages of the present invention, the three inverters and the power driver transistor and transformer must be capable of fast operation so as to provide a rise time of approximately 20 nano-seconds or less to the breakover voltage of the lamp.

The inventors are unaware of any commercially available transformer which has a sufficiently low capacitance and high breakdown voltage necessary for proper performance of the invented driver. However, one may be easily constructed by winding the core using Kynar wire with a 32 gauge conductor and a 10 mil insulator. This is to be contrasted with conventional transformer wiring such as 28 gauge copper enamel having a 10 mil conductor and a 2 mil insulator. In this connection, the typical capacitance using copper enamel wire is 100 pf as compared to a capacitance of 10 pf according to the present invention.

As previously noted, slow rise time pulses create inefficiencies. However, very fast rise time pulses can also be wasteful due to the creation of high peak current to charge up stray circuit capacity. To optimize the pulse shape, the inductance and core saturation of the transformer are optimized so as to avoid the creation of large charging currents. This optimization may be obtained as follows:

1. The total inductance at the primary should be less than approximately 3 microhenries;
2. The primary d.c. resistance should be less than approximately 50 milliohms;
3. The primary circuit should have less than approximately 0.3 turns/volt.
4. Transformer comprising of no more than one primary and only center tapped secondary;
5. The transformer should have a single winding with taps to operate as an autoformer;
6. The capacitance of the secondary winding should be less than approximately 10 pf.
7. The secondary winding should use a thick insulating material such as Kynar wire, such that the diameter of the insulator portion of the wire is approximately two times the diameter of the conductor portion of the wire.

Typically, the number of primary windings for 12 volt operation is less than 6 turns and the number of turns in the secondary is less than 300 turns. Finally, in the preferred embodiment the core is made up of ferrite material such as made by the TDK corporation model PQ 26/20.

Figure 3:
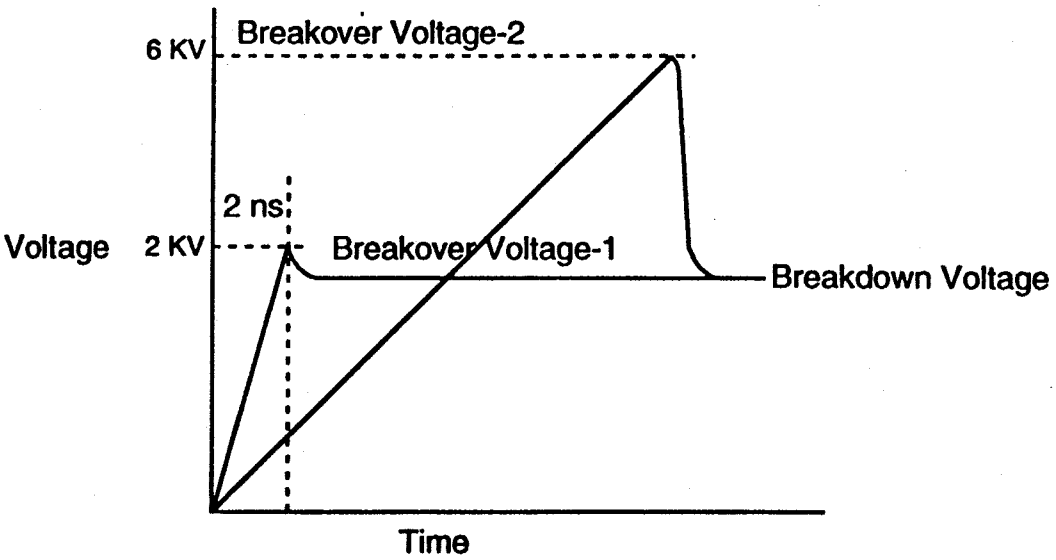
FIG. 3 is a graph showing the relative rise times and breakover voltage according to the present invention and according to a prior art driver.

FIG. 3 illustrates the concepts of the present invention in graphical form which shows a pulse having a fast rise time with a breakover voltage of 2 Kv which is slightly above the breakdown voltage. By way of contrast, prior art circuitry results in a slow rise time pulse which needs a 6 Kv breakover voltage. However, the breakdown voltage for the lamp for the slow rise time pulse is the same as the breakdown voltage for the fast rise time pulse.

It should also be noted that the reference voltage 73 can be used as an intensity control by providing a variable reference voltage. In particular, as the reference voltage decreases, the duty cycle of the pulse train is reduced which in turn produces a lower intensity output. In other words, the narrower the pulse width, the lower the intensity of the light output, and the wider the pulse width, the higher the intensity of the light output.

Figure 4:
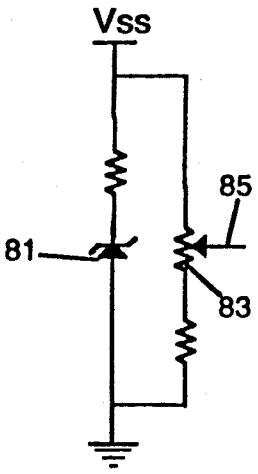
FIG. 4 is a schematic diagram of circuit for providing a variable reference voltage for use by the pulse driver circuit.

In this connection, a suitable variable reference voltage can be produced by the circuit shown in FIG. 4 comprising a zener diode 81 coupled between vss and ground and a potentiometer 83 is coupled to the zener diode in parallel wherein the wiper 83 of the potentiometer is coupled to the base of transistor 75.

By implementing a neon or gas discharge lamp driver according to the teachings of the present invention, as compared to the prior art, there is an increase in efficiency due to energy saving in preionization pulses. Additionally, the fast rise time pulses produce spontaneous ionization throughout the length of the gas tube thus producing maximum light output and reducing the preionization voltage requirements thus allowing simple, lower voltage mechanical configurations.

The invented pulse driver provides an excellent and simple intensity adjustment by changing the pulse width or the duty cycle of the pulse train. Further, the pulse driver as opposed to a resonant driver, has a low output impedance, and therefore, is sufficiently non-responsive to load characteristics of the lamp it is driving to allow optimal performance from a variety of lamps without any circuit changes. In view of the low output impedance of the pulse driver and the incorporated feedback, an open or short circuit of the output leads will not cause any damage to the driver.

The invented pulse driver offers a very fast turn-on and turn-off capability which can be used for flashing lights (for, e.g., Morse code or other communicating lights), or for providing modulation by audio and data signals for use as part of a communications system in combination with appropriate receivers.

A further advantage is that since intensity control with the invented pulse driver is possible and simple, various feedback controls can be incorporated. In this connection, current, power, and optical feedback can be used to stabilize the light output while the lamp parameters and environmental conditions change over time. With proper feedback, the invented driver is able to adjust the lamp intensity to provide constant output with battery voltage decreasing with time or for operation over a wide temperature range.

Figure 5:
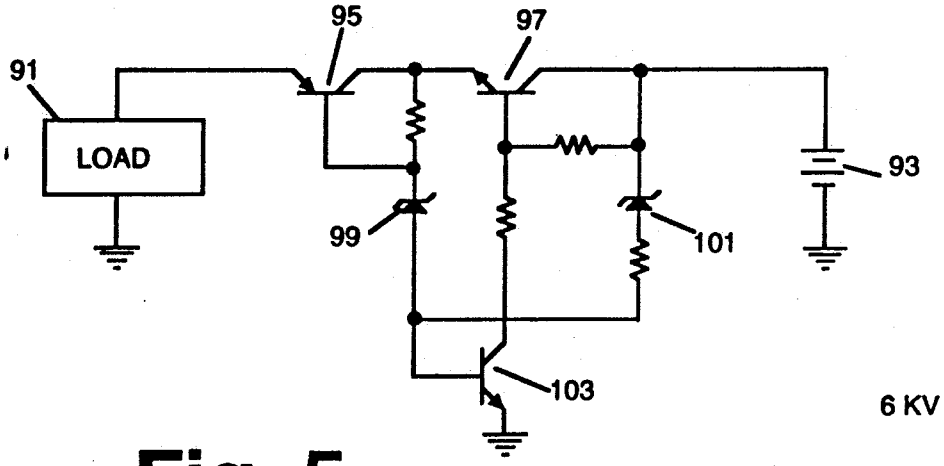
FIG. 5 is a schematic diagram of a battery cut-off circuit used with the present invention.

Another feature of the present invention is shown in FIG. 5 which is a schematic of battery voltage sensor 23 which includes a cutoff circuit which enhances the battery life of a storage battery which might typically be used to power the invented pulse driver circuit and gas discharge lamp which are represented in FIG. 5 as load 91. The storage battery is represented by battery 93. The circuit comprises voltage regulator transistor 95 which is coupled to series pass transistor 97. Zener diodes 99 and 101 are connected in series to the base of transistor 95 and the emitter of transistor 97 respectively. The zener diodes cause the series pass transistor 97 to switch off when the voltage generated by the battery drops below a predetermined value. This predetermined value is selected as the value below which the battery would be difficult or impossible to charge. In this manner, transistor 103 which applies current to the gates of transistor 97 causes the transistor 97 to be turned on and pass power from batter 93 so long as the voltage determined by the zener diodes is greater than the predetermined voltage. However, transistor 103 causes transistor 97 to turn off once the voltage drops below the predetermined voltage thereby preventing further power drain from the battery 93.

We claim:

1. A driver circuit for providing power from a power source to a neon or gas discharge lamp, said lamp having a breakover voltage which generally decreases as a function of the rise time of the pulses of a pulse train used to ionize the gases in the lamp, said circuit comprising:

a) pulse train generator means coupled to said power source for generating a pulse train having a first predetermined duty cycle;

b) switching device means coupled to said generator means for providing current pulses of said pulse train in a buck-boost mode;

c) transformer means having a primary side coupled to said switching device means and a secondary side coupled to said lamp, said transformer means for providing amplification of said pulse train, wherein said pulse train generator means, said switching device means and said transformer means are adapted to provide a rise time of said pulses of said pulse train of approximately 20 ns to the breakover voltage of said lamp;

d) pulse width control means coupled to said pulse train generator for controlling the duty cycle of said pulse train to provide a second predetermined duty cycle of said pulse train.

2. The circuit defined by claim 1 wherein said pulse train generator comprises an astable-oscillator means including an inverter having a resistor coupling the input and output of the inverter and a capacitor coupled to the input of said inverter wherein said first predetermined duty cycle is determined by said resistor and said capacitor coupled to the input of said inverter.

3. The circuit defined by claim 1 wherein said transformer means comprises:

a) transformer having primary and secondary windings made of insulated wire such that the diameter of the insulator portion of the wire is approximately two times the diameter of the conductor portion of the wire, and wherein, b) the total inductance at the primary is less than approximately 3 microhenries;

c) the primary d.c. resistance is less than approximately 50 milliohms;

d) the primary circuit has less than approximately 0.3 turns/volt.

4. The circuit defined by claim 3 wherein said transformer has no more than one primary, a center tapped secondary, a single winding with taps to operate as an autoformer, and the capacitance of the secondary winding is less than approximately 10 pf.

5. The circuit defined by claim 2 wherein said switching device means comprises a power driver transistor.

6. The circuit defined by claim 5 wherein said pulse width control means comprises a first transistor whose base is coupled to a drain of said driver transistor, whose collector is coupled to a capacitor and whose emitter is coupled to the emitter of a second transistor, the collector of said second transistor being coupled to a power source and the base of said second transistor being coupled to a reference voltage source.

7. The circuit defined by claim 6 wherein said reference voltage source is a variable reference voltage.

8. The circuit defined by claim 1 wherein said pulse width control means is coupled to an audio and data modulator adapted to generate a signal for modifying said second predetermined duty cycle.

9. The circuit defined by claim 1 wherein said pulse width control means is coupled to an optical sensor adapted to generate a signal for modifying said second predetermined duty cycle.

10. The circuit defined by claim 1 wherein said pulse width control means is coupled to a power sensor adapted to generate a signal for modifying said second predetermined duty cycle.

11. The circuit defined by claim 1 wherein said pulse width control means is coupled to a current sensor adapted to generate a signal for modifying said second predetermined duty cycle.

12. The circuit defined by claim 1 wherein said pulse width control means is coupled to a battery voltage sensor adapted to generate a signal for modifying said second predetermined duty cycle.

13. The circuit defined by claim 1 wherein said pulse width control means is coupled to a high/low power control adapted to generate a signal for modifying said second predetermined duty cycle.

14. The circuit defined by claim 2 wherein said transformer means comprises:

a) transformer having primary and secondary windings made of insulated wire such that the diameter of the insulator portion of the wire is approximately two times the diameter of the conductor portion of the wire, and wherein, b) the total inductance at the primary is less than approximately 3 microhenries;

c) the primary d.c. resistance is less than approximately 50 milliohms;

d) the primary circuit has less than approximately 0.3 turns/volt.

15. The circuit defined by claim 14 wherein said transformer has no more than one primary, a center tapped secondary, a single winding with taps to operate as an autoformer, and the capacitance of the secondary winding is less than approximately 10 pf.

16. The circuit defined by claim 2 wherein said pulse width control means is coupled to an audio and data modulator adapted to generate a signal for modifying said second predetermined duty cycle.

17. The circuit defined by claim 2 wherein said pulse width control means is coupled to an optical sensor adapted to generate a signal for modifying said second predetermined duty cycle.

18. The circuit defined by claim 2 wherein said pulse width control means is coupled to a power sensor adapted to generate a signal for modifying said second predetermined duty cycle.

19. The circuit defined by claim 2 wherein said pulse width control means is coupled to a current sensor adapted to generate a signal for modifying said second predetermined duty cycle.

20. The circuit defined by claim 2 wherein said pulse width control means is coupled to a battery voltage sensor adapted to generate a signal for modifying said second predetermined duty cycle.

21. The circuit defined by claim 2 wherein said pulse width control means is coupled to a high/low power control adapted to generate a signal for modifying said second predetermined duty cycle.

* * * * *